US010702968B2

(12) United States Patent
Gratrix et al.

(10) Patent No.: US 10,702,968 B2
(45) Date of Patent: Jul. 7, 2020

(54) MACHINE FOR FINISHING A WORK PIECE, AND HAVING A HIGHLY CONTROLLABLE TREATMENT TOOL

(71) Applicant: M Cubed Technologies, Inc., Newtown, CT (US)

(72) Inventors: Edward J. Gratrix, Monroe, CT (US); Brian J. Monti, Avon, CT (US)

(73) Assignee: M Cubed Technologies, Inc., Newtown, CT (US)

( * ) Notice: Subject to any disclaimer, the term of this patent is extended or adjusted under 35 U.S.C. 154(b) by 0 days.

(21) Appl. No.: 15/789,943

(22) Filed: Oct. 20, 2017

(65) Prior Publication Data

US 2018/0111246 A1 Apr. 26, 2018

Related U.S. Application Data

(63) Continuation of application No. PCT/US2016/046439, filed on Aug. 11, 2016.
(Continued)

(51) Int. Cl.

| | |
|---|---|
| ***B24B 49/10*** | (2006.01) |
| ***B24B 37/005*** | (2012.01) |
| ***B24B 1/00*** | (2006.01) |
| ***B24B 27/00*** | (2006.01) |
| ***B24B 37/10*** | (2012.01) |

(Continued)

(52) U.S. Cl.
CPC ..... *B24B 37/005* (2013.01); *B24B 1/00* (2013.01); *B24B 7/005* (2013.01); *B24B 7/04* (2013.01); *B24B 7/228* (2013.01); *B24B 27/0015* (2013.01); *B24B 37/107* (2013.01); *B24B 41/047* (2013.01)

(58) Field of Classification Search
CPC ..... B24B 49/10
USPC ..... 451/5, 8, 9, 10, 415, 28
See application file for complete search history.

(56) References Cited

U.S. PATENT DOCUMENTS 2,926,653 A 3/1960 Krafft
4,128,968 A * 12/1978 Jones ..... B24B 13/0018 451/158

(Continued)

FOREIGN PATENT DOCUMENTS

DE 10085092 B4 8/2007
JP H07/171747 7/1995

(Continued)

OTHER PUBLICATIONS

International Search Report dated Jan. 17, 2017 for International Application No. PCT/US2016/046439.

(Continued)

*Primary Examiner* — Robert A Rose
(74) *Attorney, Agent, or Firm* — Ramberg IP, LLC; Jeffrey R. Ramberg

(57) ABSTRACT

A machine featuring a treatment tool that grinds a surface to a desired profile, imparts a desired roughness to that surface, and removes contamination from the surface, the machine configured to control multiple independent input variables simultaneously, the controllable variables selected from the group consisting of (i) velocity, (ii) rotation, and (iii) dither of the treatment tool, and (iv) pressure of the treatment tool against the surface. The machine can move the treatment tool with six degrees of freedom.

2 Claims, 9 Drawing Sheets

Related U.S. Application Data

(60) Provisional application No. 62/205,648, filed on Aug. 14, 2015.

(51) Int. Cl.

| | |
|---|---|
| ***B24B 41/047*** | (2006.01) |
| ***B24B 7/00*** | (2006.01) |
| ***B24B 7/04*** | (2006.01) |
| ***B24B 7/22*** | (2006.01) |

(56) References Cited

U.S. PATENT DOCUMENTS

| | | | | |
|---|---|---|---|---|
| 4,956,944 | A * | 9/1990 | Ando | B24B 13/06 451/159 |
| 5,478,271 | A | 12/1995 | Thibaut | |
| 5,740,580 | A | 4/1998 | Leu et al. | |
| 5,969,972 | A | 10/1999 | Kerszykowski | |
| 6,179,695 | B1 | 1/2001 | Takahashi et al. | |
| 9,446,494 | B2 * | 9/2016 | Becker | B24B 11/00 |
| 2002/0036373 | A1 | 3/2002 | Kosakai | |
| 2006/0079162 | A1 | 4/2006 | Yamashita et al. | |
| 2007/0049168 | A1 | 3/2007 | Fujita | |
| 2010/0214549 | A1 | 8/2010 | Cadee et al. | |
| 2014/0335767 | A1 | 11/2014 | Suratwala et al. | |
| 2016/0276203 | A1 | 9/2016 | Gratrix | |

FOREIGN PATENT DOCUMENTS

| | | | |
|---|---|---|---|
| JP | H0936070 | A | 2/1997 |
| JP | 2008/166616 | | 7/2008 |
| JP | 2008300775 | A | 12/2008 |
| JP | 2010/153407 | | 7/2010 |
| JP | 2014103359 | A | 6/2014 |
| JP | 2014128877 | A | 7/2014 |
| WO | WO 2011/002881 | | 1/2011 |
| WO | WO 2013/113568 | | 8/2013 |
| WO | WO 2013/113569 | | 8/2013 |

OTHER PUBLICATIONS

International Search Report dated Apr. 12, 2016 for International Application No. PCT/US2015/062231.

Marcin Golabczak, "Polishing of Hard Semiconductor Materials Made of Silicon Carbide", *Mechanics and Mechanical Engineering*, Technical University of Lodz, Lodz, Poland, vol. 15, No. 1, (2011).

Eric W. Weisstein, *CRC Concise Encyclopedia of Mathematics*, pp. 46 and 1184, CRC Press 1999.

* cited by examiner

MACHINE FOR FINISHING A WORK PIECE, AND HAVING A HIGHLY CONTROLLABLE TREATMENT TOOL

CROSS-REFERENCE TO RELATED APPLICATION(S)

This patent document is a Continuation of International Application No. PCT/US2016/046439, filed on Aug. 11, 2016, which international application claims the benefit of U.S. Provisional Patent Application No. 62/205,648, entitled "Machine for finishing a work piece, and having a highly controllable working head", filed on Aug. 14, 2015 in the name of inventors Edward Gratrix et al. The entire contents of these two prior patent applications are incorporated by reference herein.

STATEMENT REGARDING U.S. FEDERALLY SPONSORED RESEARCH

None.

TECHNICAL FIELD

The instant invention pertains to machines that have a treatment tool for processing (e.g., grinding/lapping/polishing/texturing) a work piece so that a surface of the work piece has a desired elevation or profile (i.e., a "figure"), and desired texture (roughness/smoothness). The treatment tool may be part of a larger working head assembly.

BACKGROUND ART

Chucks, such as pin chucks, are used to hold flat components for processing. The most common use is to hold wafers (Si, SiC, GaAs, GaN, Sapphire, other) during processing to yield a semiconductor device. Other uses include holding substrates during the fabrication of flat panel displays, solar cells and other such manufactured products. These chucking components are known by many names, including wafer chucks, wafer tables, wafer handling devices, etc.

The use of pins on these devices is to provide minimum chuck-to-substrate contact. Minimum contact reduces contamination and enhances the ability to maintain high flatness. The pin tops need to have low wear in use to maximize life and precision. The pin tops also need to be low friction so the substrate easily slides on and off, and lies flat on the pins.

A pin chuck consists of a rigid body with a plurality of pins on the surface on which the substrate to be processed (e.g., Si wafer) rests. The pins exist in many geometries, and go by many names including burls, mesas, bumps, proud lands, proud rings, etc.

Regardless of whether the chuck is of the "pin" type or not, the surface that supports whatever is to be chucked (e.g., a semiconductor wafer) needs to be flat to a very high degree of precision. In the case of semiconductor lithography, the flatness is measured in nanometers (nm).

Machines exist, for example, those used in a "deterministic" fashion, to locally correct errors in flatness (surface elevation). Some techniques for this deterministic correction include, but not limited to, Ion Beam Figuring (IBF), Magneto Rheological Finishing (MRF), and computer controlled polishing (CCP). As used herein, the phrase "deterministic correction" means that figure, elevation or roughness data as measured for example, by an interferometer or profilometer, is fed into a finishing machine such as a lapping machine. The input may consist of one or more algorithms for optimizations such as convolution or transforms to optimize the tool path or footprint in such a manner that the machine most rapidly converges to the desired target shape with a minimal amount of time, cost or risk. It effectively treats those areas of the work piece that are in error and need processing (e.g., grinding, lapping or texturing), while minimizing the effort spent working on areas that are not in need or alteration. The machine does not automatically treat the entire surface of the work piece.

The instant invention is not limited to machines that operate deterministically, but it will focus on those that employ physical contact of a tool here termed a "treatment tool" with the surface of a work piece to be processed to physically remove material from the work piece through grinding, lapping, texturing and/or polishing.

FIG. 1 illustrates an example of a prior art machine. The work piece is mounted on a shaft "theta" that rotates, while treatment tool is mounted on a fixture that can move radially R with respect to the theta rotating axis. Thus, there are here two degrees of freedom of the treatment tool relative to the work piece: radius, denoted by "R", and rotation of the work piece, denoted by "theta".

One problem with this "R-theta" arrangement is that the treatment tool cannot process regions on the work piece that are very close to, or at, the center of the theta axis.

The machine of the instant invention addresses this problem, and provides a solution.

DISCLOSURE OF THE INVENTION

A machine featuring a treatment tool that contacts the surface of a work piece to grind that surface to a desired profile, impart a desired roughness to that surface, and remove contamination from the surface. The machine is configured to control multiple independent input variables simultaneously, the controllable variables selected from the group consisting of (i) velocity, (ii) rotation, and (iii) dither of the treatment tool, and (iv) pressure of the treatment tool against the surface. The machine can move the treatment tool with six degrees of freedom.

MODES FOR CARRYING OUT THE INVENTION

A machine having a treatment tool that grinds a surface to a desired profile imparts a desired roughness to that surface, and removes contamination in a single operation. The treatment tool, which may be part of a larger assembly sometimes referred to as a "working head", features a flat surface configured to contact and abrade the surface of the work piece as the treatment tool passes over it. The treatment tool may have about the same hardness as the work piece. Visually, the treatment tool may have the appearance of a disc. Alternatively, it may appear as an annulus, ring or toroid. If shaped as an annulus or ring or toroid, the space inside or within the annular space may contain a second treatment tool. Further, the treatment tool may feature a plurality of rings or toroids gathered or assembled together, and collectively defining a common flat surface.

The machine may be operated or programmed to function or respond deterministically to inputted data such as interferometer or profilometer data reporting on the elevation and/or roughness of a surface. In response to this inputted data, the machine directs the treatment tool to operate only on those spots or regions of the surface that require treatment.

In a first aspect of the invention, the treatment tool may have a number of degrees of freedom. First, it may translate in three dimensions, for example, along three orthogonal axes. Next, it may be mounted or attached to a shaft that can rotate. Further, the treatment tool can be mounted on the rotational axis of the shaft, or it can be mounted off-axis; that is, it can be mounted a certain distance away radially from said axis. Still further, the treatment tool can move radially with respect to the rotational axis. Additionally, the machine can be configured to impart "dither" to the treatment tool.

These degrees of freedom may be better illustrated with respect to the drawings.

Figure 1:
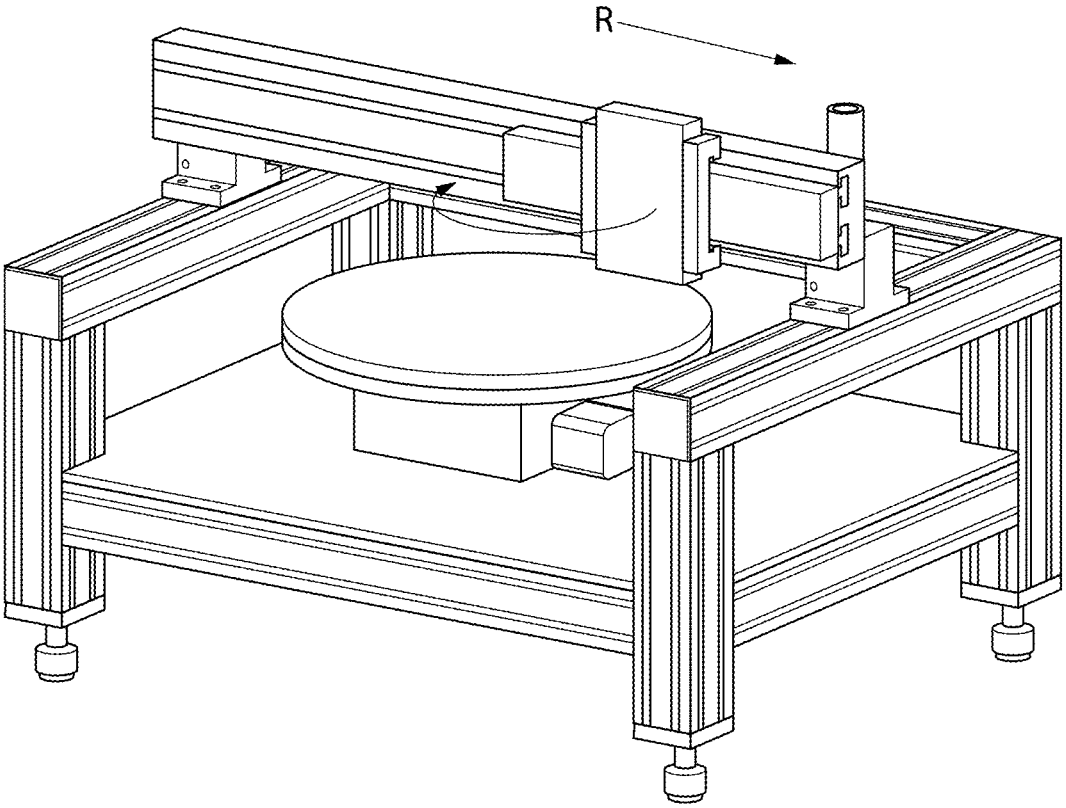
FIG. 1 (PRIOR ART)
FIG. 1 is a prior art machine showing a simple R-theta geometry

FIG. 1 illustrates a prior art machine. Here, there are two degrees of freedom: radius, denoted by "R", and rotation of the work piece, denoted by "theta".

Figure 2:
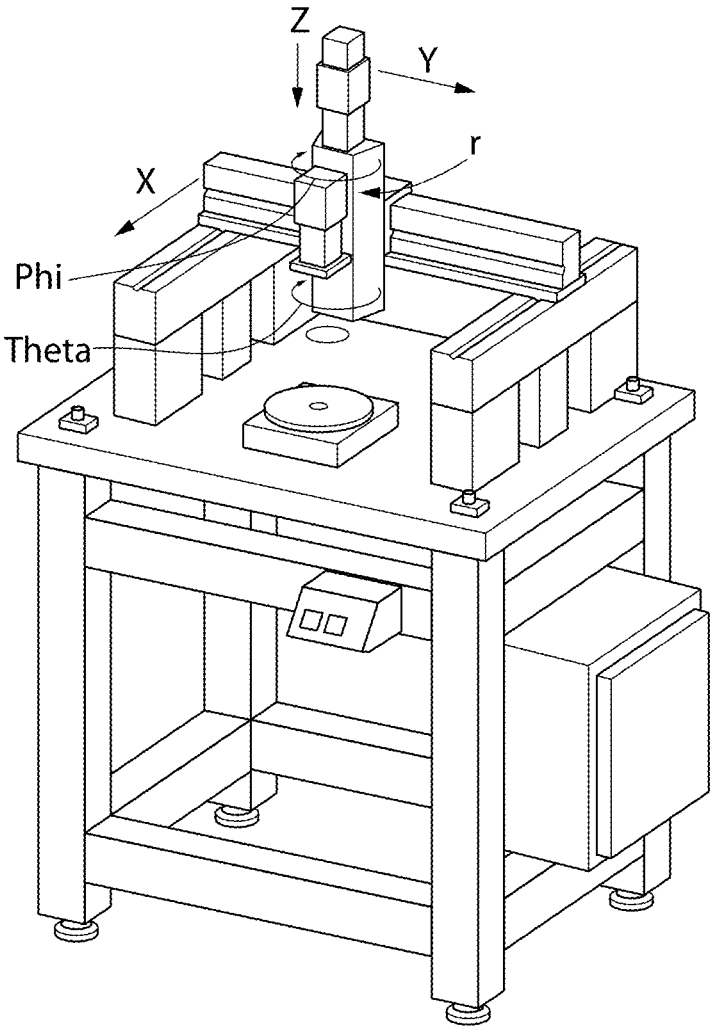
FIG. 2 is an embodiment of the machine of the present invention showing 6 degrees of freedom holding the tool and work piece

The machine of the present invention also has these two degrees of freedom, as depicted in FIG. 2. In addition, the present machine may translate the treatment tool and tool in three dimensions, for example, along "x", "y" and "z" axes, which may be orthogonal to each other. Next, it may be mounted or attached to a shaft that can rotate. Such rotation may be designated as "phi". Thus, the present machine has four additional degrees of freedom beyond the two identified in the prior art machine of FIG. 1. The priority document to the instant patent application contains a photograph of the machine.

Power for the various motions may be supplied by electric motor(s), which may be stepping motors or linear motors or common the art. Rails 21, 23, 25 mounted to table 27 may help guide the motions in the X and Y-directions. The rails may have mechanical contact bearings or air bearings or other low friction techniques known in the art.

Figure 3:
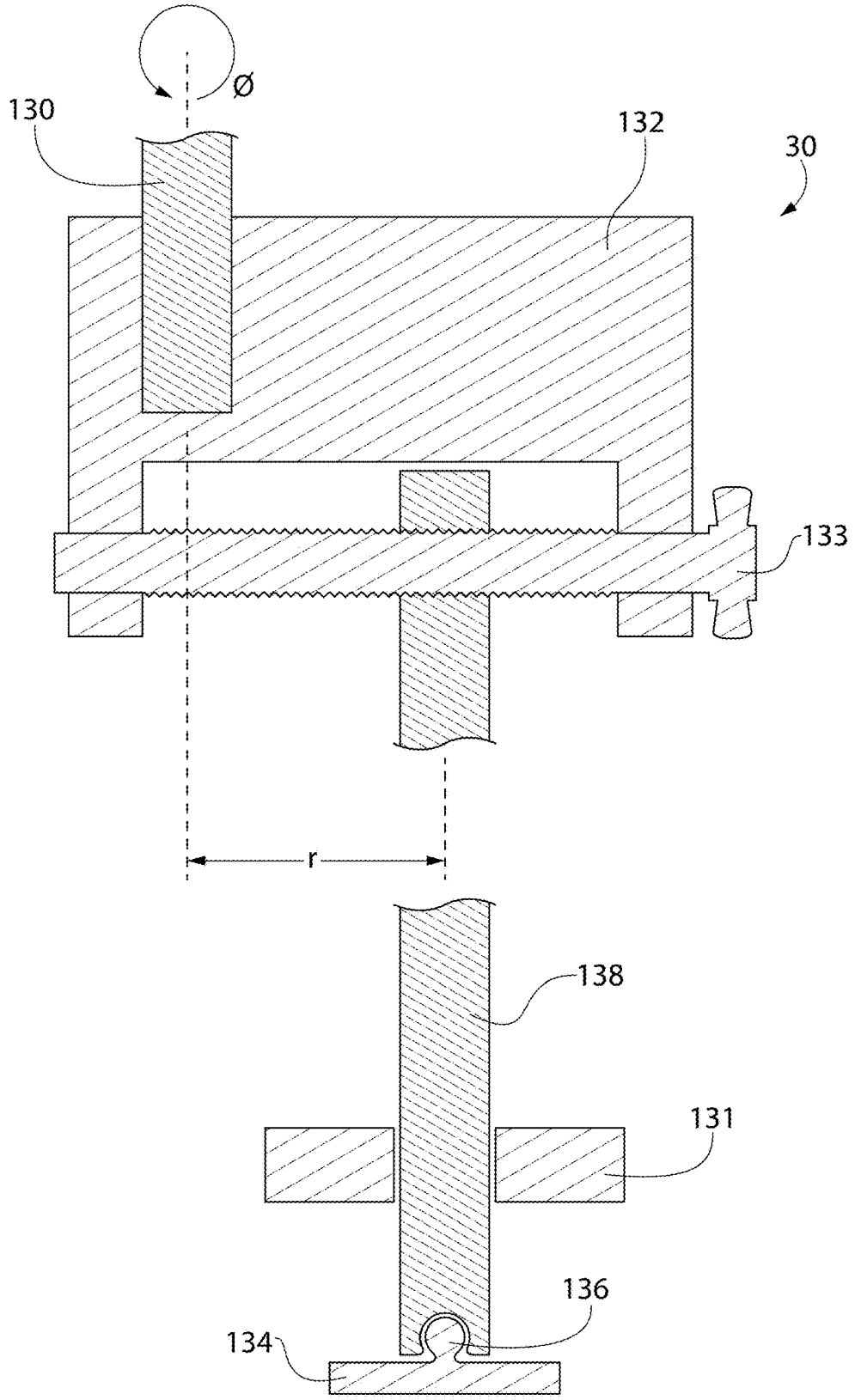
FIG. 3 is a cross-sectional schematic view of the working head that can be used in connection with the instant machine.

FIG. 3 is a cross-sectional schematic view of a "working head" 30 that can be used in connection with the instant machine. Treatment tool 134 is attached to shaft 138 whose longitudinal axis may be termed the "U" axis. The attachment may be one of minimal constraint, such as a ball-and-socket joint, or it may be at least rotationally constrained so that treatment tool 134 rotates when the U axis rotates. The U axis does not apply pressure of the treatment tool against the work piece. Rather, this pressure is applied by dead weight load 131. Rotational movement of the working head 30 is provided by input shaft 130 which defines an axis termed the "B" axis. The U axis and the B axis are firmly connected to one another through U axis adjustment block 132. This adjustment block is slotted on the bottom to allow offset adjustment of the U axis relative to the B axis. This is shown by means of adjuster screw 133. The adjuster screw may be adjusted so that the U and B axes are perfectly aligned (co-axial), or offset by an amount r (the radial offset).

Additionally, the machine can be configured to impart "dither" to the treatment tool. The nature of the dither can be random, orbital or linear. One way to impart such dither to the treatment tool is to adjust the adjuster screw so that the U axis is slightly offset from the B axis (slight amount of r), allowing the toroid to circulate in a manner such that the footprint over an undulation or dither is more controlled and smooth.

The treatment tool is 27 mm in diameter. By outward appearance, it is a disc, but in reality it has a slight toroidal shape so that when it is brought into contact with the flat surface, the area of contact is not that of a disc but instead is a circle or annulus.

The same treatment tool may be used in cleaning, profiling and roughening modes, depending upon how the tool is used. For example, given a 27 mm diameter tool fabricated from reaction bonded silicon carbide, for cleaning debris off of a wafer chuck of similar hardness, a dead weight loading of 5-50 grains, and a tool velocity of 5-30 mm/sec may be used. For profiling (e.g., flattening) a surface, the loading may be 100-175 grams, and the tool velocity may be 20-50 mm/sec. For imparting surface roughness, the tool loading may be in excess of 150 grains, and the tool velocity relative to the surface being processed may be 20-50 mm/sec.

The treatment tool may be provided in different sizes (diameter or effective diameter), depending on the size of the features or region on the work piece to be processed. For example, a smaller diameter treatment tool (for example, about 10 mm) may be used to treat recessed regions on a wafer chuck, such as the vacuum seal ring on a vacuum chuck.

Moreover, the machine can be configured to house more than one working head, and have a tool changer to swap out one working head for a different one.

In addition to the spatial degrees of freedom, and in a second aspect of the invention, the machine can be designed or programmed to respond to a number of other independent variables, which variables can be inputted to the machine simultaneously. In particular, the pressure that the treatment tool applies against the surface to be treated can be controlled, as can the amplitude and frequency of treatment tool dither. FIGS. 2 and 3 show the tool being mounted at a distance radius "r" from the center of the rotational shaft. Since "r" is one of the degrees of freedom, so the machine can move the tool along this radius. Additionally, the velocity of the treatment tool can be controlled, both in terms of the angular or rotational velocity of the shaft, as well as the translational velocity along the radius, and the translational velocity along the x, y and z axes.

The treatment tool component of the working head may be minimally constrained. That is, its orientation with respect to the surface to be treated is not fixed or prescribed. Rather, the treatment tool orients itself, or conforms to the surface, once it is brought into contact with the surface to be treated.

In a second aspect of the invention, existing machines can be modified with a "bolt-on" module to upgrade the capabilities of other machines machine. The module would be incorporated into an existing precision machine tool, such as a semiconductor lithography machine. This would allow the user of the tool to in-situ correct the wafer chucks without removing them from the lithography machine. This would reduce cost, enhance productivity, and allow real-time correction to constantly maintain like-new precision. For example, the treatment tool of the existing machine can be replaced with the Applicant's minimally constrained treatment tool. To further assist in having the treatment tool conform to the surface to be treated, the tool can be provided where the contacting surface is in the form of a ring, annulus or toroid. A further upgrade may include replacing the existing treatment tool with one having about the same hardness as the work piece. For example, if the work piece is a silicon carbide (SiC) wafer chuck, the substitute treatment tool can be made of SiC, or contain SiC, such as in the form of reaction-bonded SiC. A still further upgrade may include replacing the rotating treatment tool of a prior art machine with the working head of the present invention. Among the advantages flowing from this retrofit is the ability to apply dither, as well as the ability to approximate Cartesian (X-Y) motions using radial and rotational motions (r-phi), to be discussed in further detail below.

Moreover, since Applicant has discovered that changing the pressure at which the treatment tool contacts the surface to be treated changes the mode of operation from decontamination to processing, that is, grinding and/or modifying surface roughness, the bolt-on module includes a means for changing the application pressure of the treatment tool. The means for controlling the pressure could be in the form of software. Again, the application pressure can be controllably changed as a function of time and/or location of the treatment tool on the surface being treated. Another upgrade may consist of the module providing software or other instructions to the machine to controllably vary the velocity of translation or rotation of the treatment tool.

EXAMPLES

Aspects of the present invention will now be described with reference to the following examples.

Example 1

Cleaning a Wafer Chuck Using X and Y Motions

This Example shows how a treatment tool of the present invention can be used to clean debris off of the support surface of a wafer chuck using only X and Y orthogonal motions of the treatment tool.

Figure 4A:
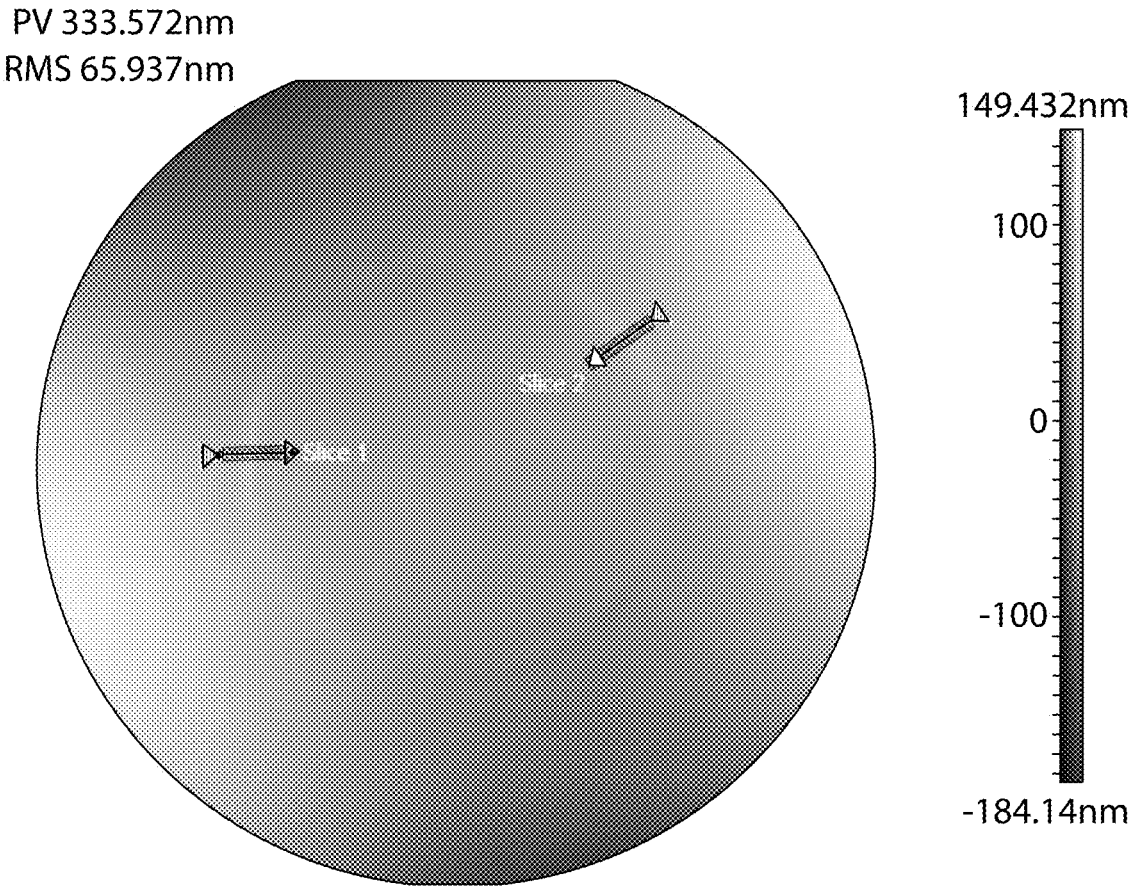
FIGS. 4A and 4B show an interferometer map and surface elevation trace, respectively, for a wafer chuck of Example 1 featuring a "trench" and debris built up along the trench.
Figure 4B:
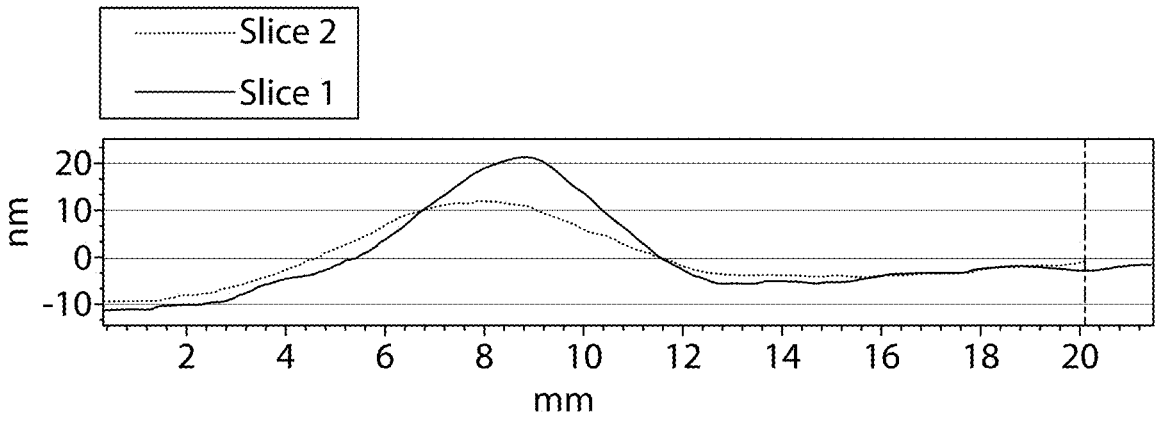

FIGS. 4A and 4B show an interferometer map and surface elevation trace, respectively, for a wafer chuck of Example 1 featuring a "trench" and debris built up along the trench. In particular, the surface elevation traces of FIG. 4B are taken along the lines identified in FIG. 4A (the interferometer map) as "Slice 1" and "Slice 2". Both of these slices show peaks or humps, corresponding to built-up debris. The accumulation of debris is typical or common in semiconductor processing.

The wafer chuck supporting surface was then treated with the 6-axis machine of the present invention using a working head containing a treatment tool described above, and operated under the cleaning conditions described above. However, only 2 of the 6 axes of the machine were used, namely, motions in a Cartesian coordinate system: X and Y directions at right angles to one another.

Figure 5A:
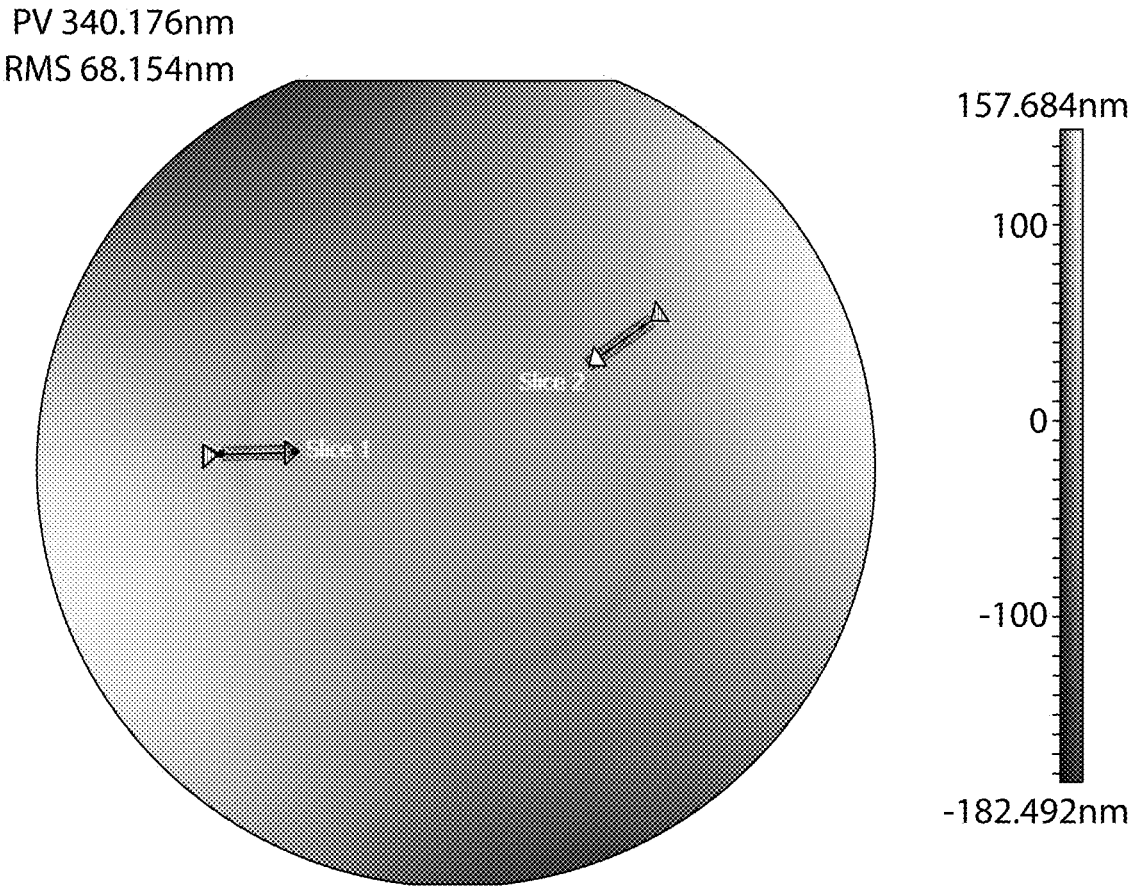
FIGS. 5A and 5B show an interferometer map and surface elevation trace, respectively, for the wafer chuck of Example 1 following a cleaning treatment.
Figure 5B:
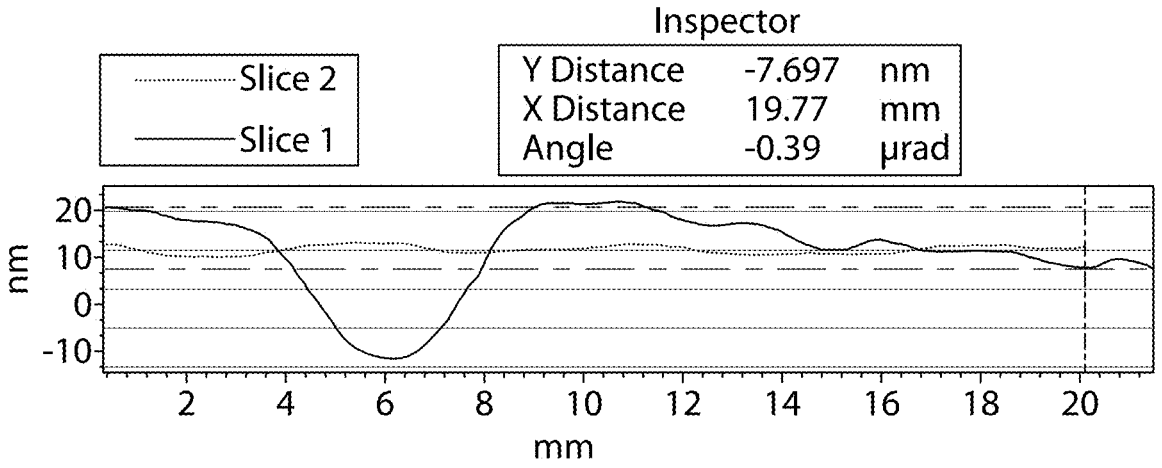

The results of this cleaning treatment are shown in FIG. 5. Again, the figure shows an interference map for the entire wafer chuck surface in FIG. 5A, and surface elevation traces for Slices 1 and 2 in FIG. 5B. A number of features stand out regarding FIG. 5B. First, the peaks or humps have been eliminated, indicating successful removal of debris. Second, the depression in Slice 1 reveals the presence of a trench in the wafer chuck surface. Third, the absence of a depression in Slice 2 indicates or suggests that the trench is present only on one side of the wafer chuck.

Thus, the treatment tool of the present invention has been used successfully to clean debris off of the support surface of a wafer chuck using only motions of the tool in orthogonal X and Y-directions. Thus, prior art machines having X and Y-motion capabilities could be retrofitted with the treatment tool of the present invention to conduct similar cleaning/decontamination.

Figure 6:
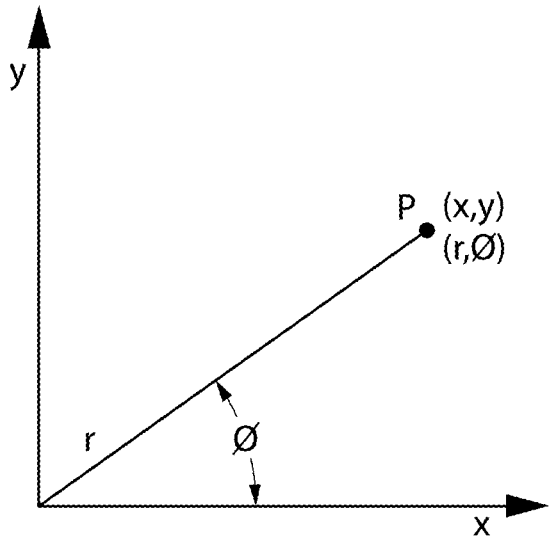
FIG. 6 is a graph of r-phi coordinates superimposed on X-Y Cartesian coordinates, showing that every point in the Cartesian coordinate system can be described by coordinates given in the r-phi system, thus emulating machines that move exclusively in a cartesian manner such as a stepper.
Figure 9:
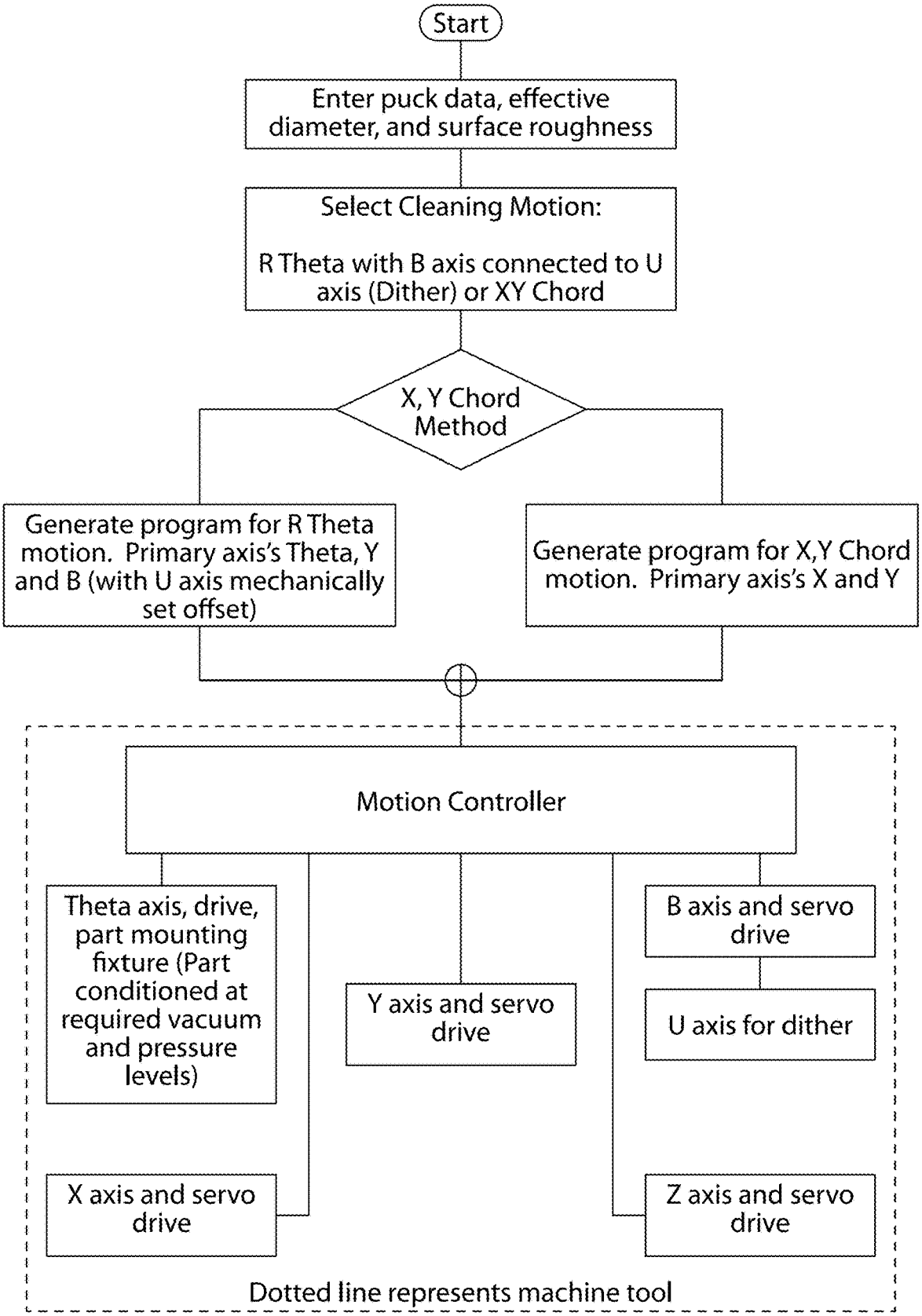
FIG. 9 is a flowchart showing how a cleaning operation may be automated.

In addition, prior art R-theta machines likewise could be retrofitted with the working head of FIG. 3 to conduct this cleaning operation. Specifically, and as depicted in FIG. 6, the X and Y orthogonal motions of the treatment tool can be approximated with r and phi (or "B" axis) motions. Specifically, every point in the X-Y cartesian coordinate system can be represented by specifying the r and phi coordinates. The smaller the increments of r and phi, the closer the approximation to X and Y orthogonal motion. Here, the B axis rotation (phi) and the radial offset, r, could be controlled by stepper motors, which could be controlled by programmable controllers. FIG. 9 provides a flowchart and block diagram for an automated cleaning operation.

Example 2

Effect of "dither" on the Wear Profile

This Example shows one use for the "dither" feature of the working head, and is made with reference to FIGS. 7 and 8.

Figure 7A:
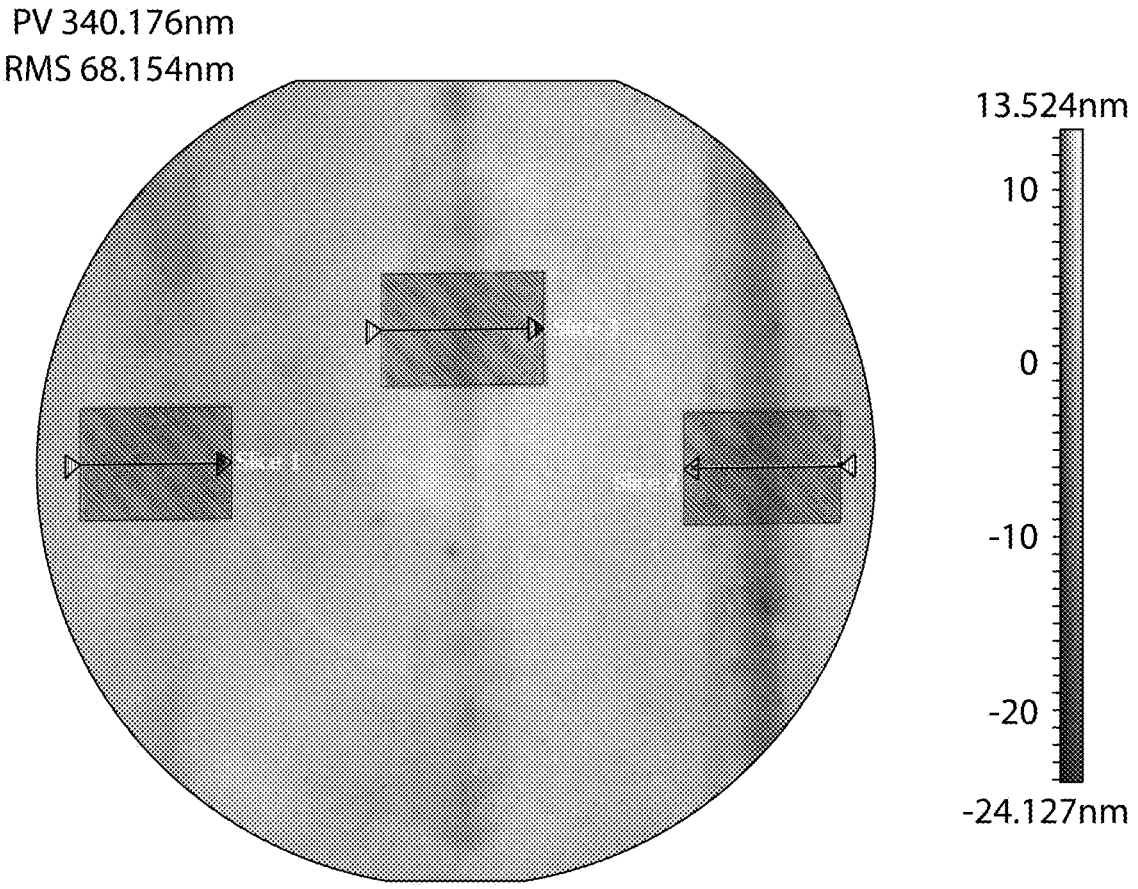
FIGS. 7A and 7B show an interference map and surface elevation trace, respectively, for a wafer chuck of Example 2 exhibiting a "W" shaped wear profile.
Figure 7B:
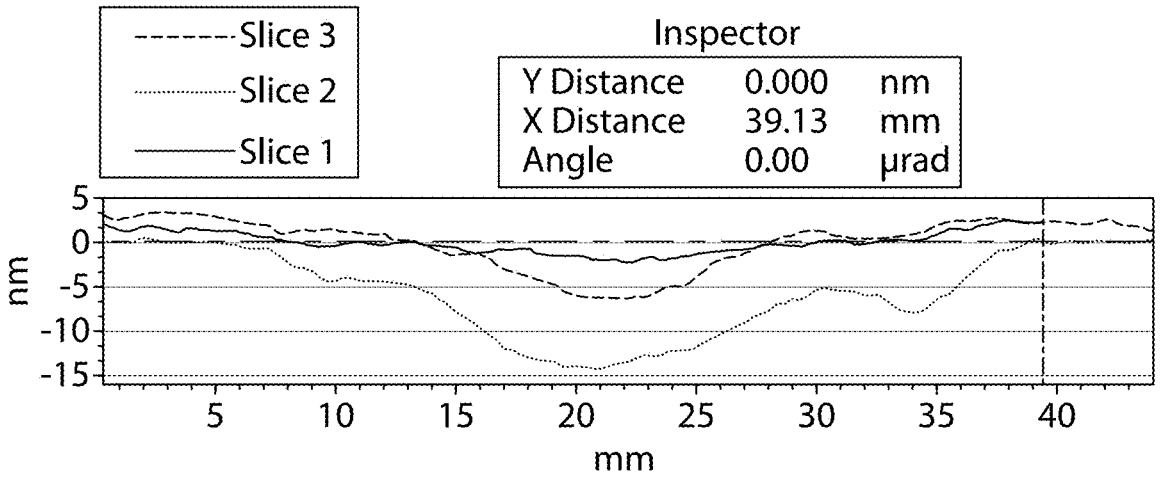

FIGS. 7A and 7B show an interference map and surface elevation trace, respectively, for a wafer chuck of Example 2

A "toroidal" shaped treatment tool having about the same hardness as the wafer chuck surface being processed was moved back and forth along a single axis (for example, the "Y" axis with an applied pressure and velocity appropriate for profiling (changing surface elevation). Again, the toroidal shape means that the contact region between the treatment tool and the wafer chuck was a circle, annulus, or ring. A surface elevation profile was then made of a "slice" of the wear path. A total of three such wear tracks and slices were made. The results are displayed as the interference map of FIGS. 7A and the surface elevation traces of FIG. 7B, respectively.

Slice 2 showed the greatest amount of material removed from the chuck surface, as evidenced both by the darkest wear path in the interference map, as well as by the deepest trace of the three slices in the surface elevation plots of FIG. 7B. Moreover, the cross-section of the wear path exhibits something resembling a "W" shape: moving away from the deepest part of the wear path, the elevation first levels out somewhat before continuing to rise to join up with the unaffected part of the wafer chuck adjacent to the wear track.

Figure 8A:
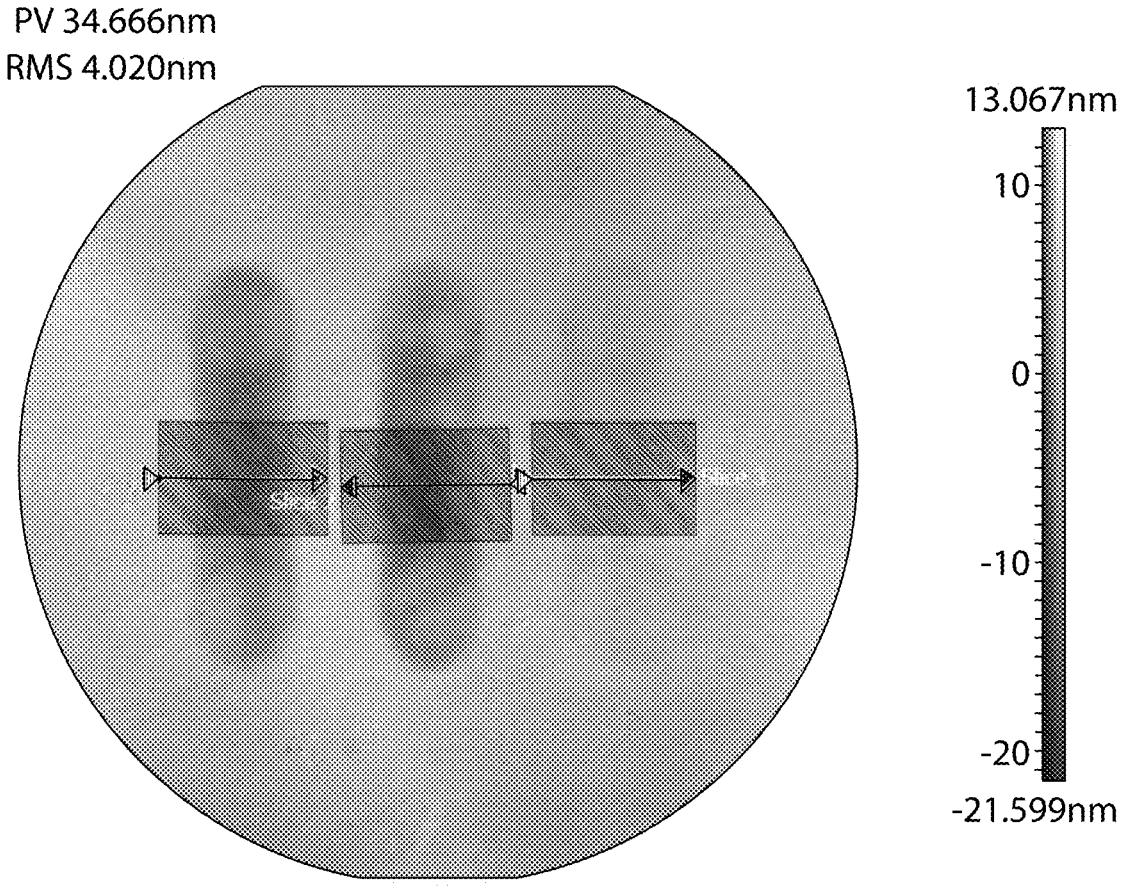
FIGS. 8A and 8B show an interference map and surface elevation trace, respectively, for the wafer chuck of Example 2 showing how dither of the treatment tool ameliorates the "W" shaped wear profile.
Figure 8B:
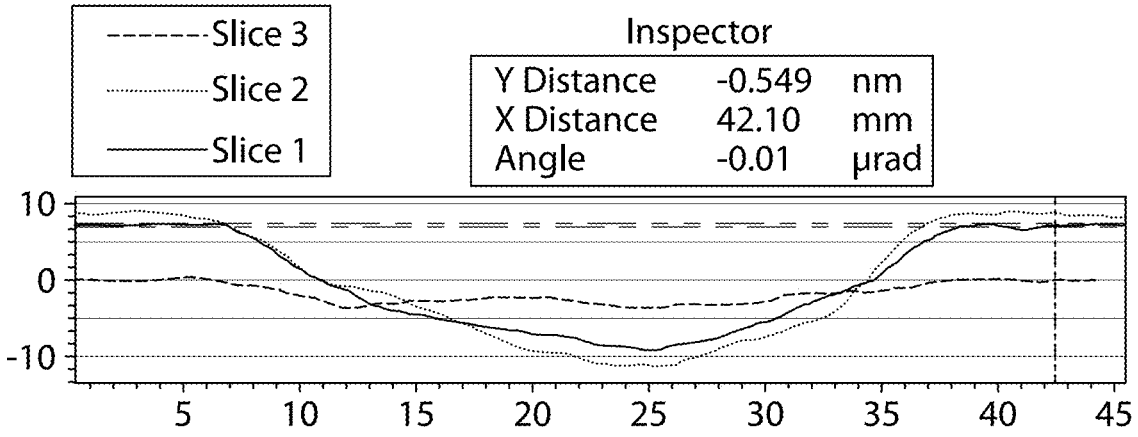

FIGS. 8A and 8B now show what happens when dither is applied to the treatment tool. The above test was repeated on a new, flat wafer chuck surface. Except for the application of dither, all of the operating parameters were kept the same as before. All three slices of the three wear tracks show significant wear (removal) of wafer chuck material. However, the cross-section of the wear tracks is much different. The "shoulders" are now gone, and each wear track has a cross-section resembling a shallow "U" shape, or closer to a Gaussian which is smoother function so as to not impart the undulations of the 'W'.

INDUSTRIAL APPLICABILITY

A single working head or treatment tool can grind, impart roughness, and remove contamination such as grinding debris from a surface to be treated. This is so because a light pressure will remove the contamination but will not modify the profile or alter the roughness of the surface. Higher pressures result in removal of substrate material from the surface being treated, not just contamination.

If the working head or treatment tool is sufficiently small in effective diameter it can be used to treat surfaces at different elevations. This is useful because in a wafer chuck having a seal ring, and pins, the seal ring is at a lower elevation than are the pin tops. A sufficiently small tool will fit within the width of the seal groove. Before treating the seal groove, however, the tool can be used to process the pin tops, for example, to correct flatness and to impart the required degree of roughness. This would be performed at relatively high application pressures. If this treatment is conducted deterministically and if the elevation map produced by the interferometer does not show too much area requiring grinding or lapping, the small diameter tool will be adequate to the task without taking too long to treat the area(s). After the tool finishes the grinding/lapping treatment, it can then be moved into the seal groove, and move circumferentially along the seal ring groove. At light application pressures, it will remove contamination but not remove substrate material, which would create additional contamination.

The "theta" and "phi" rotational axes of the instant machine typically are separate, distinct axes. As such, the treatment tool can be positioned over the center of the work piece, permitting this region of the work piece to be processed. In contrast, the treatment tool of the R-theta two degrees-of-freedom machine of the prior art cannot process this central region.

An artisan of ordinary skill will appreciate that various modifications may be made to the invention herein described without departing from the scope or spirit of the invention as defined in the appended claims.

What is claimed is:

1. A machine comprising a treatment tool that, in a single operation, grinds a surface to a desired figure, imparts a desired roughness to that surface, and removes contamination, said treatment tool comprising a contacting surface configured to contact the surface to be ground and roughened, said contacting surface (a) having a similar hardness as the surface to be ground and roughened, and (b) having a toroidal shape such that contact of said toroidal surface with a flat surface defines a circle, said machine further comprising a means for imparting dither to said treatment tool.

2. The machine of claim 1, further comprising means for controlling at least one of amplitude and frequency of said dither.

* * * * *